US009459566B2

(12) United States Patent
Kitagawa et al.

(10) Patent No.: US 9,459,566 B2
(45) Date of Patent: Oct. 4, 2016

(54) IMAGE FORMING APPARATUS CONTROLLING THE OPERATION SPEED OF EACH OF AN IMAGE FORMING PORTION AND A FIXING PORTION THEREOF WHEN AN IMAGE FORMATION PROCESS IS CONTINUOUSLY PERFORMED FOR A PLURALITY OF SHEETS

(71) Applicant: CANON KABUSHIKI KAISHA, Tokyo (JP)

(72) Inventors: Oki Kitagawa, Nagareyama (JP); Akiyoshi Shinagawa, Kashiwa (JP); Masanobu Tanaka, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/986,868

(22) Filed: Jan. 4, 2016

(65) Prior Publication Data

US 2016/0116867 A1 Apr. 28, 2016

Related U.S. Application Data

(60) Division of application No. 14/520,490, filed on Oct. 22, 2014, now abandoned, which is a continuation of application No. PCT/JP2013/062864, filed on Apr. 26, 2013.

(30) Foreign Application Priority Data

Apr. 27, 2012 (JP) ..... 2012-103002

(51) Int. Cl.
*G03G 15/20* (2006.01)
*G03G 21/14* (2006.01)

(52) U.S. Cl.
CPC ..... *G03G 15/2028* (2013.01); *G03G 15/205* (2013.01); *G03G 15/2046* (2013.01); *G03G 21/14* (2013.01); *G03G 2215/00599* (2013.01)

(58) Field of Classification Search
CPC ..... G03G 15/2028
USPC ..... 399/68
See application file for complete search history.

(56) References Cited

U.S. PATENT DOCUMENTS 4,078,166 A 3/1978 Kitamura et al.
6,393,230 B1 5/2002 Haneda et al.

(Continued)

FOREIGN PATENT DOCUMENTS

CN 102236309 A 11/2011
JP 58-87574 5/1983

(Continued)

OTHER PUBLICATIONS

International Search Report (PCT/ISA/210) dated Apr. 26, 2013, issued in PCT Application No. PCT/JP2013/062864, and Written Opinion of the International Searching Authority (PCT/ISA/237).

(Continued)

*Primary Examiner* — Susan Lee
(74) *Attorney, Agent, or Firm* — Fitzpatrick, Cella, Harper & Scinto

(57) ABSTRACT

An image forming apparatus includes an image forming device for forming an image on a sheet; a fixing device for fixing an image formed on a sheet; a detector for detecting a temperature of the fixing device, and a controller for controlling an image formation start timing in accordance with an output of the detector. In an operation of continuously forming images on a plurality of predetermined sheets, when a number of image formations is not less than a predetermined number, the start of the image formation is delayed until a temperature of the fixing device rises up to a first temperature, and when the number of image formations is less than the predetermined number, the image formation is started when the temperature of the fixing device rises up to a second temperature which is lower than the first temperature.

5 Claims, 7 Drawing Sheets

(56) References Cited

U.S. PATENT DOCUMENTS

| | | | |
|---|---|---|---|
| 7,466,934 | B2 | 12/2008 | Chae et al. |
| 7,650,105 | B2 | 1/2010 | Ogawa et al. |
| 8,208,833 | B2 | 6/2012 | Kitagawa |
| 8,364,067 | B2 | 1/2013 | Miki et al. |
| 8,532,530 | B2 | 9/2013 | Nishida et al. |
| 8,554,099 | B2 | 10/2013 | Kitagawa |
| 8,655,213 | B2 | 2/2014 | Tanaka et al. |
| 8,666,273 | B2 | 3/2014 | Tanaka |
| 8,781,345 | B2 | 7/2014 | Hitoshi |
| 8,798,514 | B2 | 8/2014 | Tanaka et al. |
| 2011/0262158 | A1 | 10/2011 | Hitoshi |
| 2012/0155944 | A1 | 6/2012 | Matsue et al. |
| 2012/0237275 | A1 | 9/2012 | Fromm |
| 2013/0051831 | A1 | 2/2013 | Shinagawa et al. |
| 2013/0058672 | A1 | 3/2013 | Takada et al. |
| 2013/0129364 | A1 | 5/2013 | Kitagawa et al. |
| 2013/0164015 | A1 | 6/2013 | Kawai et al. |
| 2013/0206745 | A1 | 8/2013 | Tanaka et al. |
| 2013/0272762 | A1 | 10/2013 | Uekawa et al. |
| 2013/0287460 | A1 | 10/2013 | Kitagawa |
| 2013/0302046 | A1 | 11/2013 | Monde et al. |
| 2014/0105634 | A1 | 4/2014 | Tanaka et al. |
| 2014/0205307 | A1 | 7/2014 | Tanaka |
| 2014/0294474 | A1 | 10/2014 | Akatsuka et al. |
| 2015/0093164 | A1 | 4/2015 | Tanaka et al. |

FOREIGN PATENT DOCUMENTS

| | | | | |
|---|---|---|---|---|
| JP | 58-95770 | | | 6/1983 |
| JP | 06072605 | A | * | 3/1994 |
| JP | 7-199720 | | | 8/1995 |
| JP | 7-311506 | A | | 11/1995 |
| JP | 10-288911 | | | 10/1998 |
| JP | 11-327354 | | | 11/1999 |
| JP | 2001-331065 | A | | 11/2001 |
| JP | 2003-280452 | | | 10/2003 |
| JP | 2006-78555 | A | | 3/2006 |
| JP | 2006-242982 | A | | 9/2006 |
| JP | 2006243377 | A | * | 9/2006 |
| JP | 2007-79064 | A | | 3/2007 |
| JP | 2010-181469 | | | 8/2010 |
| JP | 2011-242746 | A | | 12/2011 |
| JP | 2012-048118 | A | | 3/2012 |

OTHER PUBLICATIONS

Ogura, "Image Forming Device", Aug. 4, 1995, JP07-199720A, Machine Translation by JPO, Detailed Description and Description of Drawings.

Japanese Office Action issued in counterpart Japanese Patent Application No. 2012-103002, dated Dec. 1, 2015.

Chinese Office Action issued in corresponding Chinese Application No. 201380033157.8 dated Jun. 21, 2016.

* cited by examiner

IMAGE FORMING APPARATUS CONTROLLING THE OPERATION SPEED OF EACH OF AN IMAGE FORMING PORTION AND A FIXING PORTION THEREOF WHEN AN IMAGE FORMATION PROCESS IS CONTINUOUSLY PERFORMED FOR A PLURALITY OF SHEETS

This is a division of U.S. patent application Ser. No. 14/520,490, filed on Oct. 22, 2014.

FIELD OF THE INVENTION

The present invention relates to an image forming apparatus for forming an image on a recording material.

BACKGROUND ART

In an image forming apparatus for forming an image on a recording material, in order to apply the proper heat depending on the kind of the used recording material in a fixing device (image heating device), it is preferable that the applied heat quantity is changed. Therefore, in a device disclosed in Japanese Laid-open Patent Application 2006-78555, when the kind of the recording material changes from plain paper to a thick sheet, which has a large thermal capacity, the image forming operation is started after the temperature rise of the fixing device up to a target temperature higher than a target temperature for the plain paper.

In a device disclosed in Japanese Laid-open Patent Application Hei 7-311506, when the kind of the recording material changes from plain paper to a thick sheet, the process speed (image forming speed, operation speed of the fixing device) is switched to an operation speed which is lower than for the plain paper, and then the image forming operation is started.

However, with the device disclosed in Japanese Laid-open Patent Application 2006-78555, the start of the image formation is delayed until a sufficient temperature rise of the fixing device, irrespective of the number of image formations on the thick sheets, and therefore, the productivity of image formation decreases. For example, in an apparatus capable of processing at a speed of 60 sheets per minute after the temperature rise, if the waiting time for the temperature rise is 30 sec, and only two sheets are processed, and the resulting productivity is only four sheets per minute.

In the apparatus disclosed in Japanese Laid-open Patent Application Hei 7-3111506, it is liable that the productivity of image formation decreases, because the image formation is started after switching of the process speed to a low speed after completion of the image formation on the plain paper, irrespective of the number of subsequent image formations on thick sheets. Here, the change of the process speed may require changes of a voltage application condition of image forming means and/or a heating condition of the fixing device, which may result in an even longer waiting time. For example, in the case that the image formation is carried out with a productivity of 60 sheets per minute after the switching of the process speed to that for thick sheets, and the condition change requires 30 second, the resultant productivity is only 4 sheets per minute if only two thick sheets are processed.

SUMMARY OF THE INVENTION

Accordingly, it is a principal object of the present invention to provide an image forming apparatus capable of proper image forming operations with the waiting time reduced as much as possible.

According to an aspect of the present invention, there is provided an image forming apparatus comprising: image forming means for forming an image on a recording material; fixing means for fixing an image formed on a recording material; detecting means for detecting a temperature of the fixing means; and controlling means for controlling an image formation start timing in accordance with an output of the detecting means. In an operation of continuously forming images on a plurality of predetermined recording materials, when the number of image formations is not less than a predetermined number, the start of the image formation is delayed until a temperature of the fixing means rises up to a first temperature, and when the number of image formations is less than the predetermined number, the image formation is started when the temperature of the fixing means rises up to a second temperature which is lower than the first temperature.

According to another aspect of the present invention, there is provided an image forming apparatus comprising: image forming means for forming an image on a recording material; fixing means for fixing an image formed on a recording material; detecting means for detecting a temperature of the fixing means; and controlling means for controlling an image formation start timing in accordance with an output of the detecting means. In an operation of continuously forming images on a plurality of predetermined recording materials, when the number of image formations is not less than a predetermined number, the start of the image formation is delayed until the temperature of the fixing means rises up to a target temperature predetermined on the basis of a kind of the recording material, and when the number of image formations is less than the predetermined number, the image formation is started when the temperature of the fixing means rises up to a predetermined temperature which is lower than the target temperature.

According to a further aspect of the present invention, there is provided an image forming apparatus comprising: image forming means for forming an image on a recording material; fixing means for fixing an image formed on a recording material; and controlling means for controlling an image formation start timing. In an operation of continuously forming images on a plurality of predetermined recording materials, when the number of image formations is not less than a predetermined number, operation speeds of image forming means and the fixing means are controlled in accordance with the kind of recording material, and when the number of image formations is less than the predetermined number, the operation speeds of the image forming means and the fixing means is controlled at speeds higher than the operation speeds determined in accordance with the kind of the recording material.

According to a further aspect of the present invention, there is provided an image forming apparatus comprising: image forming means for forming an image on a recording material; fixing means for fixing an image formed on a recording material; detecting means for detecting a temperature of the fixing means; first controlling means for controlling a target temperature of the fixing means in accordance with a basis weight of recording material;

and second controlling means for starting image formation. Images are formed continuously on a plurality of recording materials having a first basis weight in a state that the temperature of the fixing means is controlled at a first target temperature predetermined in accordance with the basis weight of the recording material, and then successively, images are formed continuously on a plurality of recording materials having a second basis weight which is larger than the first basis weight, and the start of image formation is awaited until the temperature of the fixing means rises up to a second target temperature predetermined in accordance with the basis weight of the recording material if the number of image formations is not less than a predetermined number, and the image formation is started when the temperature of the fixing means rises up to a predetermined temperature lower than the second target temperature, when the number of image formations is less than the predetermined number.

According to a further aspect of the present invention, there is provided an image forming apparatus comprising: image forming means for forming an image on a recording material; fixing means for heating an image formed on a recording material; first controlling means for controlling the operation speeds of the image forming means and the fixing means in accordance with a basis weight of the recording material; and second controlling means for starting image formation. When images are formed continuously on a plurality of the recording materials having a first basis weight in a state that operations speeds of the image forming means and the fixing means are a first image forming speed and first fixing speed, respectively, and successively, images are formed continuously on a plurality of the recording materials having a second basis weight which is larger than the first basis weight, the second controlling means starts the image formation after decreasing the operation speeds of the image forming means and the fixing means to the second image forming speed and the second fixing speed which are slower than the first image forming speed and the first fixing speed, respectively, if the number of image formations is not less than the predetermined number, and the second controlling means starts the image formation while maintaining the operation speeds of the image forming means and the fixing means at the first image forming speed and the first fixing speed, respectively, if the number of image formations is less than the predetermined number.

Other objects of the present invention will become apparent when the following detailed description is read in conjunction with the accompanying drawings.

DESCRIPTION OF THE EMBODIMENTS

Embodiments of the present invention will be described in detail referring to the accompanying drawings. The embodiments may be modified by replacing a part of entirety of the structures of the following embodiments with a substitute within a concept of the present invention.

<Image Forming Apparatus>

Figure 1:
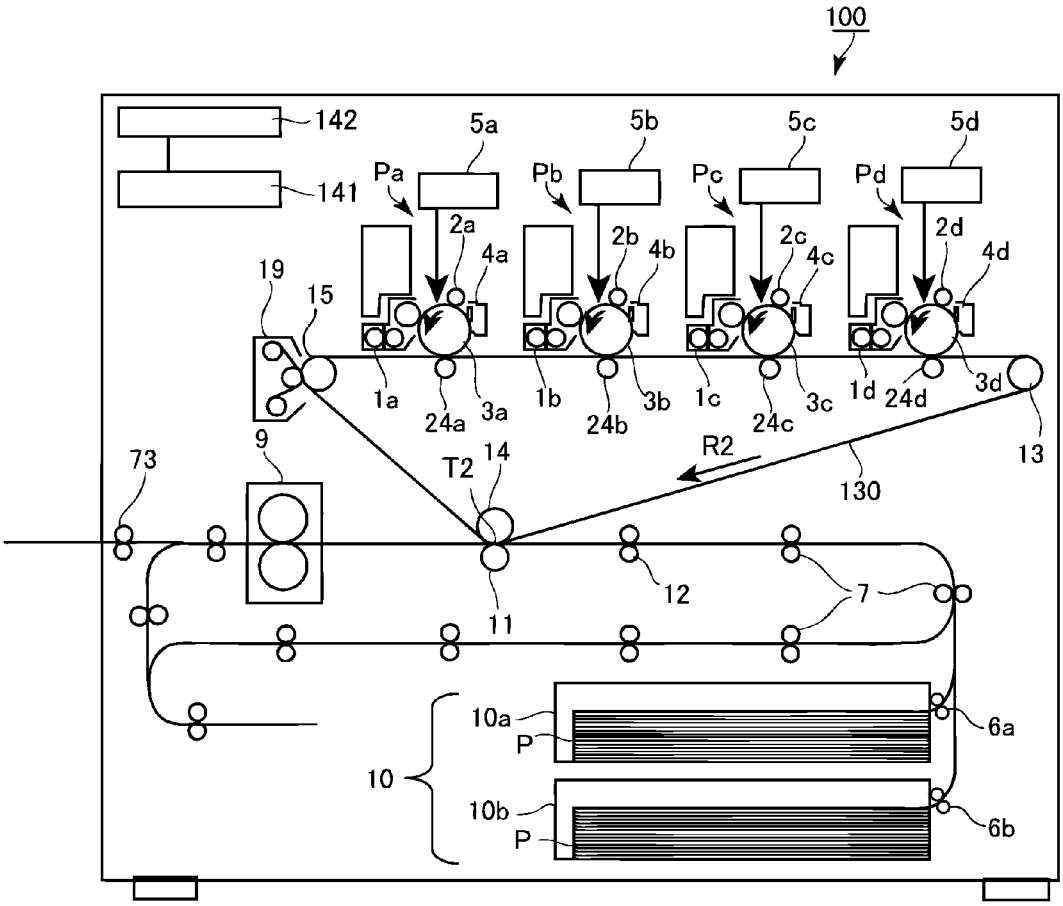
FIG. 1 is an illustration of a structure of an image forming apparatus.

FIG. 1 is an illustration of a structure of an image forming apparatus. As shown in FIG. 1, an image forming apparatus 100 comprises an image forming portion functioning as image forming means for forming an image on a recording material, and a fixing device functioning as fixing means for fixing an image formed on a recording material. More specifically, in this example, the image forming portion includes four image forming stations, a mechanism for transferring images formed by the image forming stations, that is, an intermediary transfer member, a recording material cassette accommodating the recording materials, a feeding mechanism for feeding the recording material to a secondary transfer portion, and so on, The image forming apparatus in this embodiment is a full color printer of a tandem type and an intermediary transfer type in which the yellow, magenta, cyan and black image forming stations Pa, Pb, Pc and Pd are arranged along an intermediary transfer belt 130 as the intermediary transfer member.

In an image forming station Pa, a yellow toner image is formed on a photosensitive drum 3*a*, and is transferred onto the intermediary transfer belt 130. In an image forming station Pb, a magenta toner image is formed on the photosensitive drum 3*b*, and is transferred onto the intermediary transfer belt 130. In an image forming stations Pc and Pd, cyan and black toner images are formed on photosensitive drums 3*c* and 3*d*, and are transferred onto the intermediary transfer belt 130, respectively.

Four color toner images carried on the intermediary transfer belt 130 are fed to a secondary transfer portion T2 and are secondary-transferred all together onto a recording material P there. The recording materials P are supplied from the recording material cassette 10*a* one by one by a separation roller 6*a*, and are fed to registration rollers 12. The registration rollers 12 feed the recording material P to the secondary transfer portion T2 in timed relation with the toner image on the intermediary transfer belt 130.

The recording material P carrying the secondary-transferred four color toner images is separated from the intermediary transfer belt 130 by the curvature of the secondary transfer roller 11 and the opposing roller 14, and is fed into a fixing device 9. The fixing device 9 fixes the image on a surface of the recording material P by heating and pressing the recording material P carrying the toner images. Thereafter, the recording material P is discharged to an outside. The image forming apparatus 100 is capable of continuous printing by repeating the process including the sheet feeding, the registration, the image formation, the fixing and the sheet discharge.

As shown in FIG. 1, the image forming stations Pa, Pb, Pc, Pd have substantially the same structures except that developing devices 1*a*, 1*b*, 1*c* and 1*d* contain different color developers, respectively. Therefore, in the following, a description will be provided as to the yellow image forming station Pa, and the like reference numerals with different suffixes are assigned to the elements having the corresponding functions throughout the description.

In the image forming station Pa, around the photosensitive drum 3*a*, there are provided a charging roller 2*a*, an exposure device 5*a* a developing device 1*a*, a transfer roller 24*a* and a drum cleaning device 4*a*. The photosensitive drum 3*a* comprises an aluminum cylinder and a light semiconductor photosensitive layer on the outer peripheral surface thereof, and is rotated at a predetermined process speed in the direction indicated by the arrow. The image forming apparatus 100 can produce 80 A4 size full-color images per minute at the process speed 320 mm/sec.

The charging roller 2*a* electrically charges the photosensitive drum 3*a* uniformly to a dark portion potential VD of negative polarity. The exposure device 5*a* scanningly projects a laser beam ON-OFF modulated scanning line image data provided by expanding yellow separated color image, onto the surface of the photosensitive drum 3*a*, using a rotational mirror, so that an electrostatic image is formed on the surface of the photosensitive drum 3*a*. The developing device 1*a* supplies the toner to the photosensitive drum 3*a* to develop the electrostatic image into a toner image.

The transfer roller 24*a* is pressed against the intermediary transfer belt 130 to constitute a toner image transfer portion between the photosensitive drum 3*a* and the intermediary transfer belt 130. By the application of a DC voltage to the transfer roller 24*a*, the toner image carried on the photosensitive drum 3*a* is transferred onto the intermediary transfer belt 130. The drum cleaning device 4*a* includes a cleaning blade contacted to the photosensitive drum 3*a* to scrape untransferred toner which has passed through the transfer portion and remaining on the surface of the photosensitive drum 3*a*, off the surface of the photosensitive drum 3*a*.

The intermediary transfer belt 130 is stretched around a tension roller 15, an opposing roller 14, and a driving roller 13, and is driven by the driving roller 13 to rotate in the direction indicated by an arrow R2. In the secondary transfer portion T2, a secondary transfer roller 11 is contacted to the intermediary transfer belt 130 supported by the opposing roller 14. By applying a DC voltage to the secondary transfer roller 11, the toner image carried on the intermediary transfer belt 130 is secondary-transferred onto the recording material P fed through the secondary transfer portion T2. A belt cleaning device 19 includes a cleaning web (nonwoven fabric) contacted to the surface of the intermediary transfer belt 130 to remove the toner and/or paper dust.

<Controller>

Figure 2:
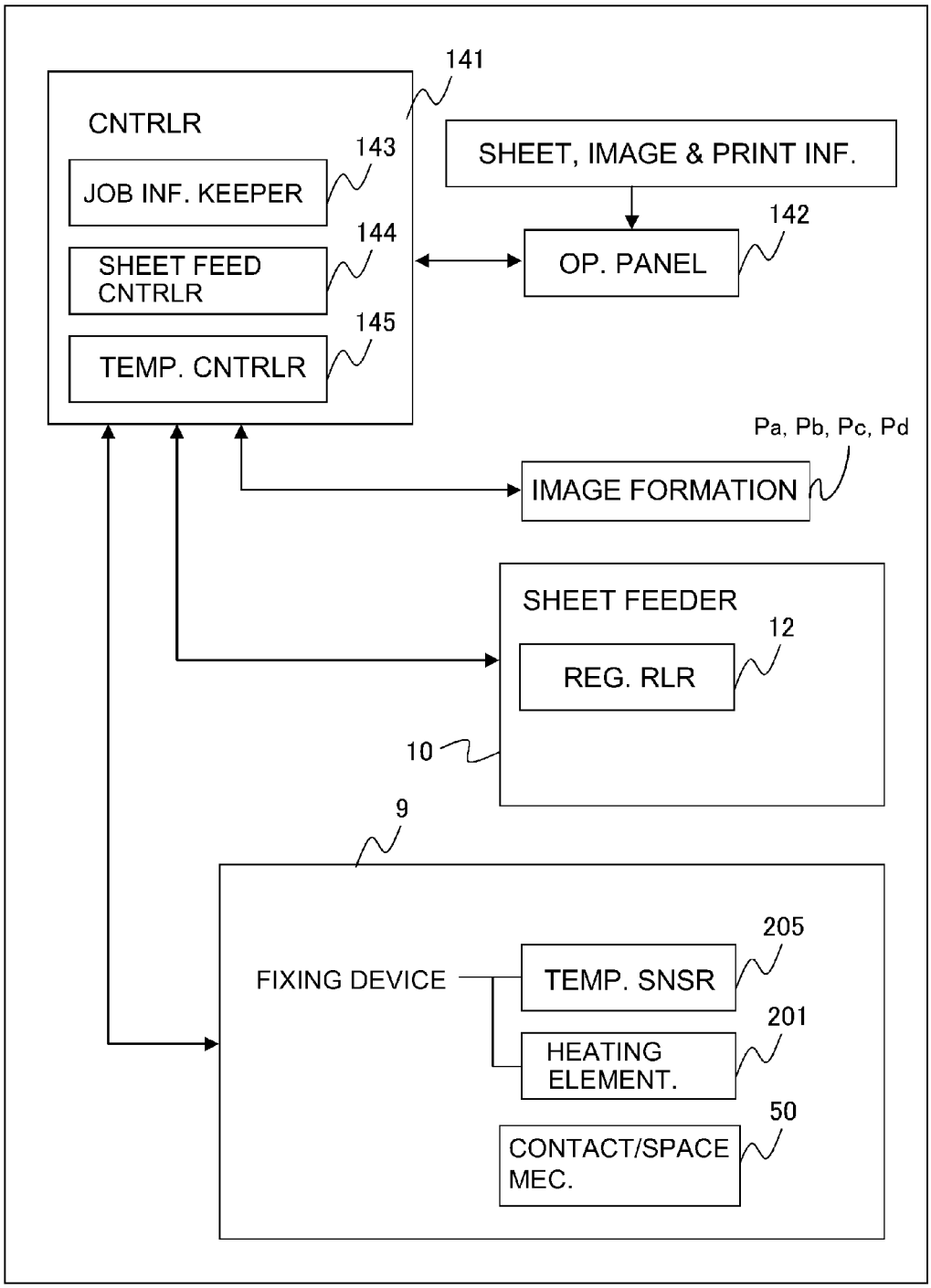
FIG. 2 is a block diagram of a control system of the image forming apparatus.

FIG. 2 is a block diagram of a control system for the image forming apparatus. As shown in FIG. 2, a controller 141 as controlling means monitors and controls operation of each unit, and governs the instructions for the respective units so as to effect overall control of the entire operation of the various devices of the image forming apparatus 100.

An operation panel 142 is an interface for the user to access the image forming apparatus 100, and the user can set, through the operation panel 142, image formation job (recording material information such as a basis weight, image information such as a density, print number, and the like).

The image forming apparatus 100 is capable of executing a so-called mixed job in which continuously printing is carried out on different kinds (basis weight) recording materials. Recording material cassettes 10*a*, 10*b* are capable of feeding plain paper, thin sheet and a thick sheet as the recording material into the heating nip N.

By carrying out the mixed job, one complete paperbound book comprising a thick sheet front cover, thin sheet documents and coated paper photographs can be produced. The user can set, on the operation panel 142, details of the mixed job, such as temperature setting of the fixing device 9 for each recording material.

In addition, such image formation job information can be set for the image forming apparatus 100, from an external personal computer as well as the operation panel 142. The inputted information is temporarily stored in a job information keeping portion 143 which is a part of the controller 141, and is used as control parameters for various operations during the job execution.

As shown in FIG. 1, the registration rollers 12 include a rubber roller of ethylene, propylene rubber having a diameter of ϕ 16 mm on the recording material back side, and a metal roller of SUS having a diameter of ϕ16 mm on the recording material front side, wherein the metal roller is press contacted to the rubber roller by a 1 kg load. The rubber roller has an ASKER-C hardness of 40°(1 kg load), and a surface roughness Rz of approx. 20 μm.

The registration rollers 12 temporarily stop the recording material P by a feeding nip formed by the rubber roller and the metal roller to prevent oblique feeding of the recording material, and feed out the recording material P in timed relation with the image formation to assure the proper positioning of the image on the recording material. The controller 141 rotates the rubber roller by operating a stepping motor (unshown) so as to control the feeding and stopping of the recording material when feeding the recording material toward the secondary transfer portion T2.

<Fixing Device>

Figure 3:
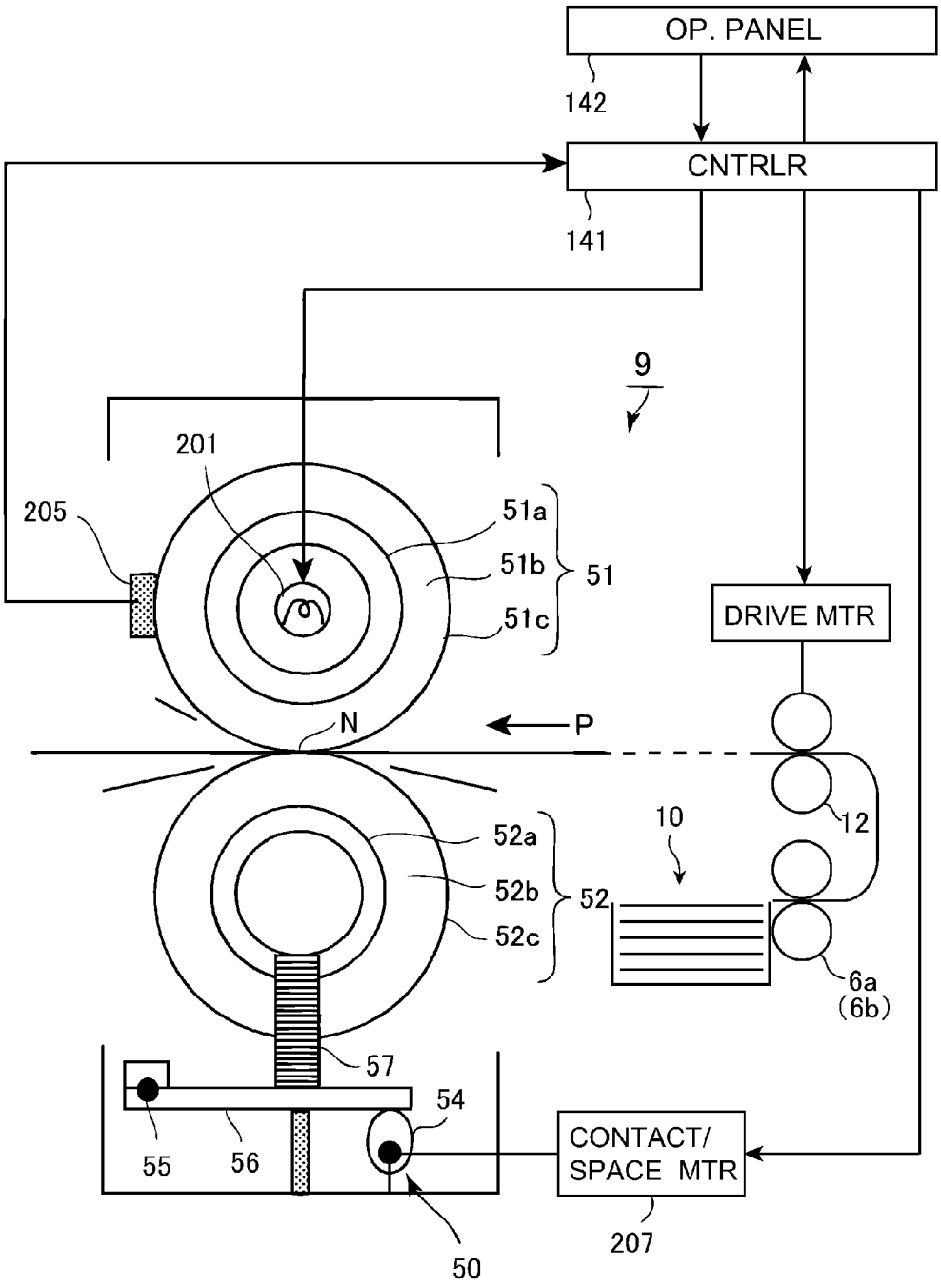
FIG. 3 is an illustration of a structure of a fixing device in a cross-sectional view.

FIG. 3 is an illustration of a structure of the fixing device functioning as fixing means, in a cross-section. As shown in FIG. 3, the recording material P passes through the fixing device 9 in the direction from the right-hand side to the left-hand side in the figure, and the recording material P is subjected to heat and pressure in the nip N formed between the image surface side fixing roller 51 and a non-image surface side pressing roller 52, by which the toner image fixed on the surface of the recording material P. In the fixing device 9, the heating nip N is formed by press-contacting the pressing roller 52 to the fixing roller 51, functioning as a heating member, the temperature of which is controlled at a level not less than a melting point of the toner.

The fixing roller 51 comprises a metal core of a mild steel cylindrical material having an outer diameter of (ϕ 72 mm, an elastic layer 5 1*b* of silicone rubber having a thickness of 4 mm on an outer periphery thereof, a parting layer 5I*c* of a PFA tube having a thickness of 30 μm on a surface of the elastic layer 51*b*. The pressing roller 52 comprises a metal core of a mild steel cylindrical material having an outer diameter of ϕ 76 mm, an elastic layer 52*b* of silicone rubber having a thickness of 2 mm on an outer periphery thereof, and a parting layer 52*c* of PFA tube having a thickness of 30 μm on a surface of the elastic layer 52*b*.

Inside the fixing roller 51, there is provided a 900 W heating element (halogen heater) 201 functioning as heating means. A temperature sensor (the mister) 205 functioning as detecting means is contacted to a surface of the fixing roller 51 at an exit side of the heating nip N in a center portion with respect to a rotational axis direction.

A temperature control portion 145 controls electric power supply to the heating element 201 on the basis of the output of the temperature sensor 205, so that the surface temperature of the fixing roller 51 detected by the temperature sensor 205 becomes a target temperature, which is determined in accordance with the kind (basis weight) of the recording material.

The fixing device 9 includes a moving mechanism 50 for press-contacting and spacing the pressing roller 52 to and from the fixing roller 51. The fixing device 9 waits for the image formation job in the state that the fixing roller 51 and the pressing roller 52 are spaced from each other and that the fixing roller 51 is controlled at a target temperature of a stand-by state.

Opposite end portions of the metal core 51*a* of the fixing roller 51 are rotatably supported by bearings, the height position of which is fixed. Opposite end portions of the metal core 52*a* of the pressing roller 52 are supported through a pressing spring 57 by a pressing frame 56, which is rotatable about a rotational shaft 55.

When a contacting and spacing motor 207 rotates the pressing cam 54 to raise a rotation end of the pressing frame 56, the pressing roller 52 rises and contacts to the fixing roller 51 by a pressure of the pressing spring 57. When the contacting and spacing motor 207 rotates the pressing cam 54 to lower the rotation end of the pressing frame 56, the pressing roller 52 is lowered to be spaced from the fixing roller 51.

The controller 141 controls the contacting and spacing motor 207 to effect the pressing and releasing of the pressing roller 52 to switch between the pressing state and the spaced state relative to the fixing roller 51. The total load in the press-contact state of the pressing roller 52 by the moving mechanism 50 is approx. 60 kgf, and a heating nip N having a length of approx. 10 mm in the feeding direction is formed.

The moving mechanism 50 reduces the thermal load required when the fixing roller 51 is to be heated to a stand-by temperature by the spacing of the pressing roller 52 from the fixing roller, upon a starting operation, by which the warming-up time is reduced. By the spacing of the pressing roller 52 from the fixing roller, the heat is not deprived of the fixing roller 51, and therefore, the warming-up time is reduced, and the electric energy consumption of the fixing device 9 is reduced, too. In addition, the moving mechanism 50 spaces the pressing roller 52 from the fixing roller 51 when the recording material P is jammed, to facilitate the jam clearance operation by the user.

Comparison Example

Recently, the image forming apparatus is desired to have a high productivity and to be capable forming images on various kinds of recording materials. In the fixing device 9, the nip is expanded in the feeding direction, the thermal conductivity of the heating member is raised, and the heating efficiency and/or the electric power efficiency is raised to reduce the energy loss, so that the heat quantity required for continuous toner image fixing on the recording material is assured. In the fixing device 9, the target temperature of the temperature adjustment for the fixing roller 51 is changed depending on whether the recording material is a thin sheet or a thick sheet, or depending on whether the recording material is non-coated paper or coated paper, so that more kinds of the recording material can be used. In the fixing device 9, depending on the kinds of the recording material, the an optimum heat quantity is different in terms of an image property (toner offset property, image glossiness or the like) and the feeding performance (sheet creasing, sheet waving, image fixing, sheet separation or the like), and therefore, the target temperature of the temperature adjustment of the fixing roller 51 is switched depending on the kinds of the recording material. In the fixing device 9, for a recording material falling in a particular group or groups a recording material classified depending on the basis weight or surface property of the recording material, and the feeding speed through the fixing device is switched to a speed lower than a normal speed in order to increase the accumulated heat quantity supplied by the fixing nip.

However, when such a method is employed to address the various kinds of the recording materials, the productivity at the time when various recording materials are mixed can be increased. When the so-called mixed job in which different kinds of the recording materials are mixed, the down time at the change of the kind of the recording materials would be a problem. Because it requires time to switch the temperature condition of the fixing device and/or the process speed, a waiting time is necessitated with the result of an overall productivity reduction. According to the embodiments of the present invention, the reduction of the down time resulting from the switching of the kinds of the recording materials in the mixed job in which different kinds of the recording materials are mixed is intended, so that the overall productivity as the image forming apparatus is improved.

<Embodiment 1>

Figure 4:
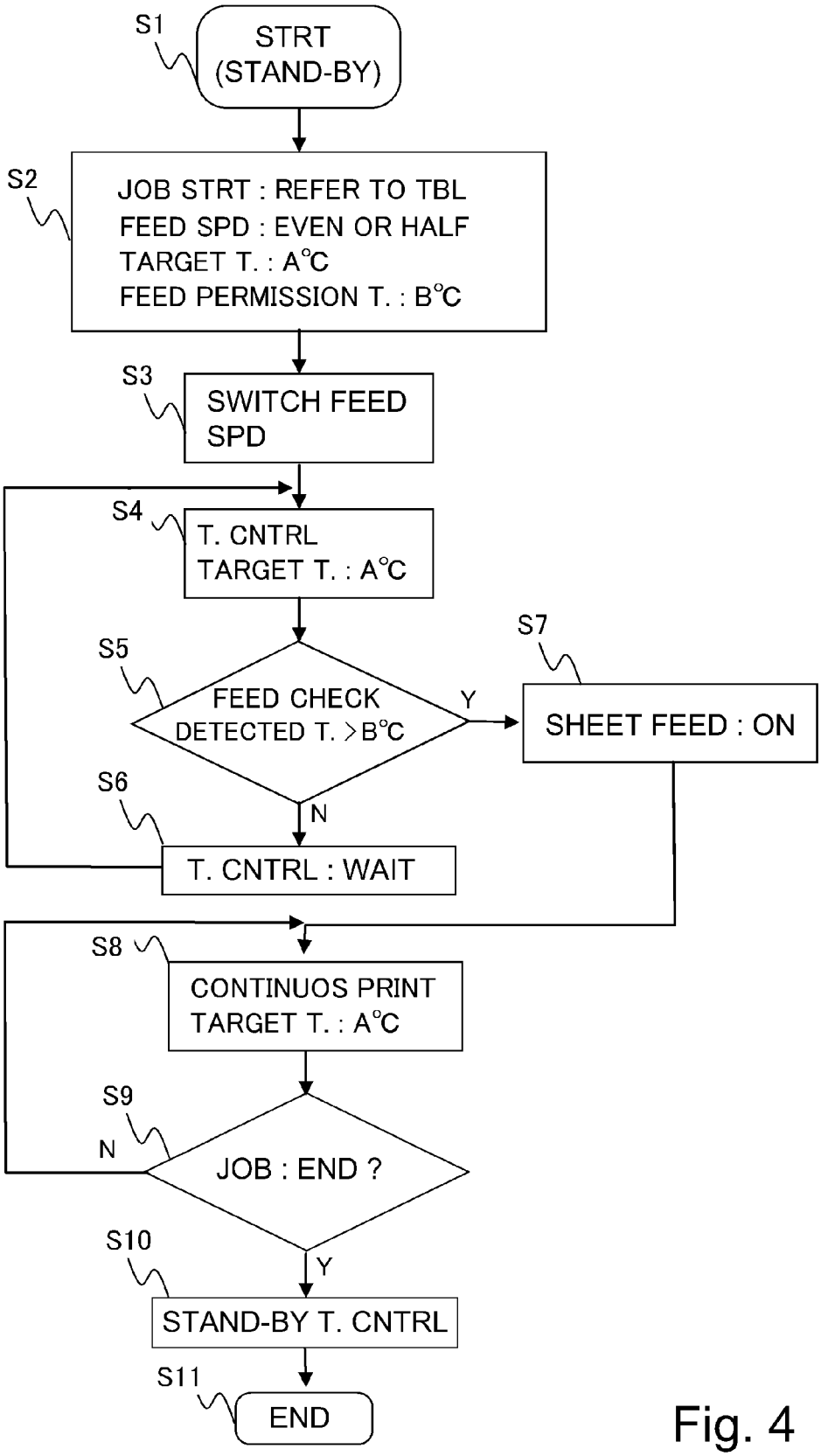
FIG. 4 is a flow chart of a control according to Embodiment 1.
Figure 5:
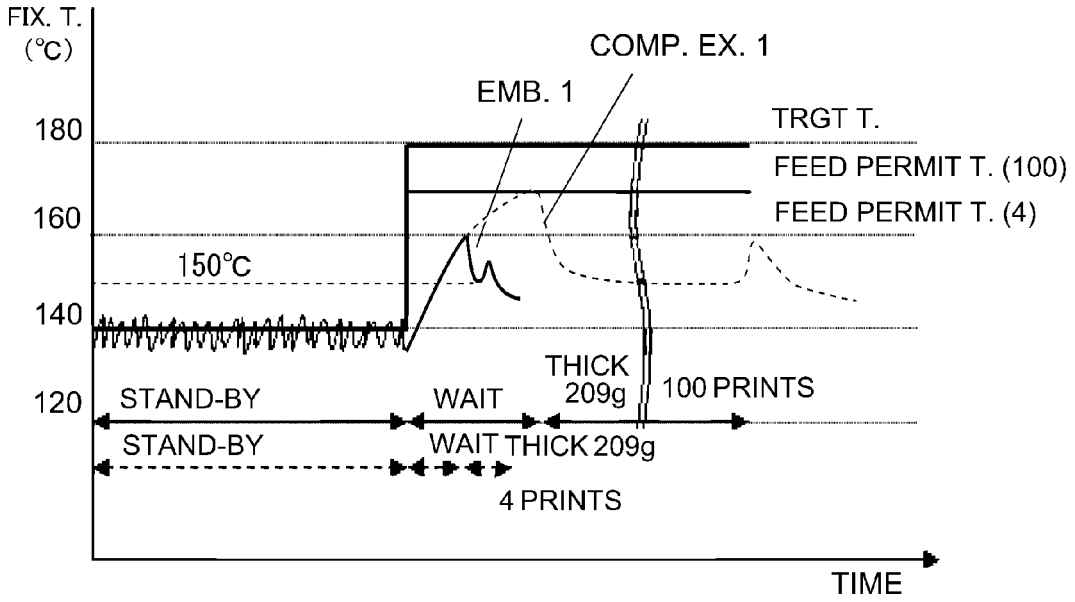
FIG. 5 is an illustration of a temperature change of a fixing roller at the time when a process on the thick sheet is started from a stand-by state.

FIG. 4 is a flow chart of a control according Embodiment 1. FIG. 5 is an illustration of a temperature change of the fixing roller at the time when an image formation on a thick sheet is started from a stand-by state.

As shown in FIG. 1, the image forming station Pa includes the photosensitive drum 3*a*, which is an example of the rotatable photosensitive member on which images are formed. A fixing device 9, which is an example of the image heating apparatus, includes a fixing roller, which is an example of the rotatable image heating member for heating the image formed on the recording material in contact with it.

As shown in FIG. 3, the fixing roller 51, which is an example of the image heating member, heats an image surface of the recording material. The pressing roller 52, which is an example of the pressing member, is press-contacted to the fixing roller 51 to form a nip for the recording material. The temperature sensor 205, is an example of the detecting means, detects the temperature of the fixing roller 51 to output temperature information. Registration rollers 12 are an example of feeding means feed the recording material to the nip of the fixing device 9 through the secondary transfer portion T2.

The moving mechanism 50 contacts and spaces the fixing roller 51 and the pressing roller 52 relative to each other. The controller 141 is an example of a contacting and spacing controller and controls the fixing roller 51 at a second temperature in the state that the pressing roller 52 is spaced by the moving mechanism 50, and press-contacts the pressing roller 52 thereto to form a nip immediately before the feeding of the recording material.

The controller 141 including controlling means, the temperature control portion and the feeding controller, for example controls the sheet feeder 10 on the basis of the temperature information while controlling the fixing roller 51 at the predetermined temperature. When the number of image formations of the image formation job is not less than a predetermined number, the recording material is fed to the nip at the timing when the temperature of the fixing roller 51 rises to the first temperature. When images are formed continuously on a plurality of predetermined recording materials, the start of the image formation is delayed until the temperature of the fixing roller 51 rises to the first temperature in the case that the number of image formations is not less than a predetermined number. However, in the case that the number of image formations is less than a predetermined number, the recording material is fed at the timing when the temperature of the fixing roller 51 rises to a second temperature, which is lower than the first temperature.

The above-described image formation start timing onto the photosensitive member 3*a* is uniquely determined from the paper reaching timing to the fixing nip and the process speed. As for the earliest timing, the image formation is started on the basis of prediction so that the recording material having been subjected to the image formation at the timing of the fixing roller 51 reaches the second temperature when it reaches the fixing nip. As for the second earliest timing, the image formation is started on the basis of a prediction so that the toner image is transferred onto the recording material at the timing when the fixing roller 51 reaches the second temperature. As for the timing later than that, the image exposure of the photosensitive drum 3*a* is started at the timing when the temperature of the fixing roller 51 reaches the second temperature. In the image forming apparatus of this embodiment, when the process speed is 320 mm/sec, the sheet reaches the fixing nip 2.5 sec after the start of the image formation. Therefore, in this embodiment, the image exposure of the photosensitive drum 3*a* is started 2.5 sec prior to the timing at which the temperature of the fixing roller 51 reaches the second temperature, on the basis of a preset temperature rise curve of the fixing roller 51.

The controller 141 looks up data in Table 1, on the basis of the information of the kind of recording material and the print number temporarily stored in the job information keeping means 143 when receiving the image formation job. By this, the feeding speed, the target temperature of the fixing temperature adjustment and the sheet feeding permission temperature, which will be described hereinafter, are determined. Table 1 shows the feeding speed, the target temperature of the temperature adjustment and the sheet feeding permission temperature for respective kinds of the recording material, in Embodiment 1.

TABLE 1

| | Feeding speed | Target temp. of temp. adjustment (Deg. C.) | Print No. Of Job | Sheet feed permission Temp. (Deg. C.) Not less than 5 | Less than 5 |
|---|---|---|---|---|---|
| Stand-by temp. | 0 | 140 | | Non | Non |
| Thin (52-63) | Even | 130 | | 120 | 110 |
| Plain (64-105) | Even | 150 | | 130 | 120 |
| Thick 1 (106-128) | Even | 160 | | 150 | 130 |
| Thick 2 (129-157) | Even | 170 | | 160 | 150 |
| Thick 3 (158-209) | Even | 180 | | 170 | 160 |
| Thick 4 (210-256) | Half | 160 | | 150 | 140 |

As shown in Table 1, for thin sheets, the target temperature is relatively low in consideration of the separation property from the fixing roller 51, in order to prevent wrapping around (jamming). The thick sheet requires a large thermal load of fixing roller 51, and therefore, the target temperature is relatively higher in order to assure the fixing power for the toner image. In the setting in each range of the recording materials, the supplied heat quantity is large if the thermal capacity is large, in order to satisfy both of the image property (fixing offset property and image glossiness) and feeding performance (crease, separation property). In the case of a thick sheet 4, the thermal capacity of the recording material is the largest, and therefore, the recording material feeding speed in the nip is one half of the normal speed.

(1) the target temperature for the thin sheet (52-63g/$m^2$) is 130 degrees C., and the process speed is 320 mm/sec.

(2) the target temperature for the plain paper (64-105g/$m^2$) is 150 degrees C., and the process speed is 320 mm/sec.

(3) (3) the target temperature for the thick sheet 1 (106-128g/$m^2$) is 160 degrees C., and the process speed is 320 mm/sec.

(4) the target temperature for the thick sheet 2 (129-157g/$m^2$) is 170 degrees C., and the process speed is 320 mm/sec.

(5) the target temperature for the thick sheet 1 (158-209g/$m^2$) is 180 degrees C., and the process speed is 320 mm/sec.

(6) the target temperature for the thick sheet 4 (210-256g/$m^2$) is 160 degrees C., and the process speed is 160 mm/sec.

The fixing roller 51 of the image forming apparatus 100 is made of a material having a relatively large thermal capacity, and therefore, the initial warming-up time is long. In view of this, in order that the target temperature of the temperature adjustment is quickly reached upon reception of the printing signal, it is preferable to effect the control for the stand-by temperature adjustment even when the normal printing operation is not carried out. As for the target temperature of the stand-by temperature adjustment, the initial setting thereof is 140 degrees C. so that the highest speed print is carried out with the thin sheet (52-63g/$m^2$) and plain paper (64-105g/$m^2$). By the initial setting of 140 degrees C. for the stand-by temperature of the fixing roller 51, no waiting time occurs for the plain paper which is the most frequently used, so that the image formation can be carried out instantaneously. As for the stand-by temperature, the target temperature of the temperature adjustment can be changed in the operating portion 142. If the user frequently uses thick sheets, the temperature can be changed to 150°C., 160°C., 170°C. or the like.

The sheet feeding permission temperature is a temperature (trigger) of the fixing roller 51 at which the image formation starts by operating the sheet feeder 10 after the target temperature of the temperature adjustment is switched as described in the foregoing, simultaneously with the production of the start signal of the job by the controller 141. The sheet feeding operation control portion 144 in the controller 141 operates the sheet feeder 10 when the detected temperature of the fixing roller 51 by the temperature sensor 205 exceeds the sheet feeding permission temperature.

The controller 141 is provided with a plurality of tables so that the sheet feeding permission temperature can be selected depending on the print number (A4 conversion value) of the job. In Embodiment 1, two tables are prepared for the case of not less than five sheet (A4 conversion value) prints and in the case of less than five sheet (A4 conversion value) prints, respectively. This is because if the number of prints is less than five, even if the temperature of the fixing roller 51 at the time of the start of the sheet passing is low, the printing job will be completed before the temperature drop after the start falls in the range out of the tolerable range.

(1) for a thin sheet, the sheet feeding permission temperature is lowered from 120 degrees C. to 110 degrees C.

(2) for plain paper, the sheet feeding permission temperature is lowered from 140 degrees C. to 130 degrees C.

(3) for a thick sheet 1, the sheet feeding permission temperature is lowered from 150 degrees C. to 140 degrees C.

(4) for a thick sheet 2, the sheet feeding permission temperature is lowered from 160 degrees C. to 150 degrees C.

(5) for a thick sheet 3, the sheet feeding permission temperature is lowered from 170 degrees C. to 160 degrees C.

(6) for a thick sheet 4, the sheet feeding permission temperature is lowered from 150 degrees C. to 140 degrees C.

Referring to FIG. 3 and FIG. 4, the controller 141 starts preparation for the image formation when the controller 141 receives execution instructions of the image formation job during the stand-by state (S1). Here, it is assumed for example that the controller 141 receives an image formation job of 100 prints on one side of A4 size thick sheets 3 (158-209 g/m2) (S1).

The controller 141 looks up Table 1 and determines the job feeding speed, the target temperature A degrees C of the fixing temperature adjustment and the sheet feeding permission temperature B degrees C on the basis of the recording material information and the print number information kept in the job information keeping portion 143 (S2). More particularly, the controller 141 determines, from Table 1, that the feeding speed is the same, the target temperature of temperature adjustment of the fixing roller 51 is 180 degrees C., and the sheet feeding permission temperature is 170 degrees C. (S2).

The controller 141 starts various means (the image forming station, the fixing device or the like) in the device at predetermined feeding speeds.

The fixing temperature controller 145 of the controller 141 controls the heating element 201 on the basis of the temperature information supplied from the temperature sensor 205 to start temperature raising of the fixing roller 51. The heating element 201 is operated from the stand-by temperature control 140 degrees C. toward the target temperature 180 degrees C. of the temperature adjustment for the thick sheet 3. By this, the temperature of the fixing roller 51 starts rising.

The controller 141 effects a sheet feeding discrimination of the recording material P (thick sheet 3) relative to a current temperature of the fixing roller 51. Since the sheet feeding permission temperature is 170 degree C., the image formation is awaited until the detected temperature of the fixing roller 51 by the temperature sensor 205 exceeds 170 degrees C. When the fixing roller 51 is heated, and the temperature thereof rises (S4-S6) up to 171 degrees C.> sheet feeding permission temperature 170 degrees C., the controller 141 produces a sheet feeding operation signal to the sheet feeder 10 (S7).

Thereafter, the controller 141 sets the target temperature of the temperature adjustment at 180 degrees C., and executes the continuous print operation.

When the controller 141 discriminates completion of the job (S9, Y), the controller 141 returns the target temperature of the temperature adjustment to the stand-by temperature (S10), and a series of operations is finished.

FIG. 5 show a temperature change of the surface of the fixing roller 51 in the operation according to the operation flow of Embodiment 1. The fixing device 9 requires a surface temperature of the fixing roller 51 of not less than 150 degrees C. in order to stably fix the toner image carried on the recording material which is thick sheet 3. With continuous sheet processing, the surface temperature of the fixing roller 51 decreases to a level at which the electric power demand-supply balance is reached.

As shown in FIG. 5 by a solid line, when an image formation job of 100 A4 size prints on the thick sheet 3 from the stand-by state is executed, the start of the image forming operation is awaited until the detected temperature of the fixing roller 51 exceeds the sheet feeding permission temperature 170 degrees C. When the number of the prints of the image formation job is large, a long waiting time for the temperature adjustment is required in order to make the surface temperature of the fixing roller 51 at the job start relatively higher. After the start of the image formation, the fixing roller 51 is deprived of heat by the recording material of the thick sheet 3 to reach a balanced state at the surface temperature 150 degrees C. of the fixing roller 51, and the image formation job is completed without falling to a level less than 150 degrees C. required for the heat fixing of the toner image.

Referring to FIG. 3 and FIG. 4, when a job of prints on one sides of four A4 size thick sheets 3 is received in the stand-by state, the image formation is started (S7) before the detected temperature of the fixing roller 51 by the temperature sensor 205 reaches 170 degrees C. Referring to Table 1, the controller 141 determines that the sheet feeding permission temperature is 160 degrees C. (S2) because the job is four A4 size prints. Therefore, the waiting time (S4-S6) required for the temperature adjustment occurs up to the positive sheet feeding discrimination (S5, Y).

As shown in FIG. 5 by a solid line, when the image formation job of four prints on A4 size thick sheets 3 is executed in the stand-by state in Embodiment 1, the image forming operation is started at the time when the detected temperature of the fixing roller 51 reaches 160 degrees C., which is prior to the sheet feeding permission temperature of 170 degrees C. When the print number of the image formation job is small, the temperature drop of the fixing roller 51 is small, and correspondingly it is unnecessary to wait until the temperature is very high when the job operation starts. During a later start of the image forming operation, the surface temperature of the fixing roller 51 decreases by the recording material of the thick sheet 3 taking the heat away, but the image formation job is completed before the temperature falls down to a level lower than 150 degrees C. required to heat fix the toner image. Therefore, as compared with the case in which the image forming operation is awaited until the temperature reaches the sheet feeding permission temperature of 170 degrees C. (broken line) in comparison example 1, the time from the reception of the image formation job to the completion of the image formation is reduced.

According to the control of Embodiment 1, the sheet feeding permission temperature is changed to an optimum level in accordance with the already obtained print number information of the job, by which the temperature control waiting time can be reduced. For the execution of the image formation job, the optimum sheet feeding permission temperature is determined on the basis of the kind of the recording material and the job print number information, by which the necessary and minimum temperature control waiting time may be used. By executing the job, with the appropriate switching control corresponding to the recording material information and the job print number information, the down time necessary for the media switching can be minimized. By this, the down time upon a media (recording material) change can be minimized.

<Embodiment 2>

Figure 6:
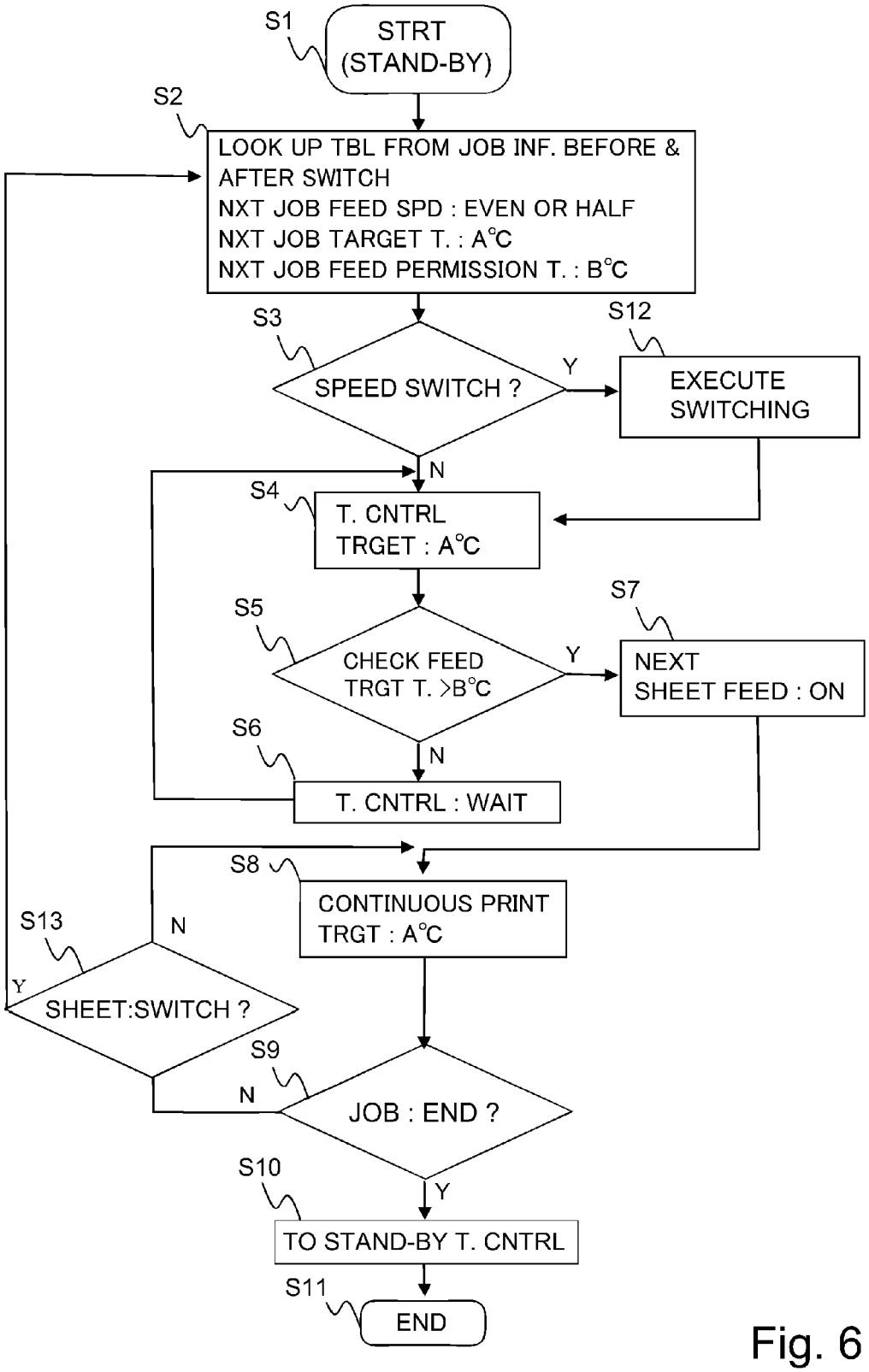
FIG. 6 is a flow chart of a control according to Embodiment 2.
Figure 7:
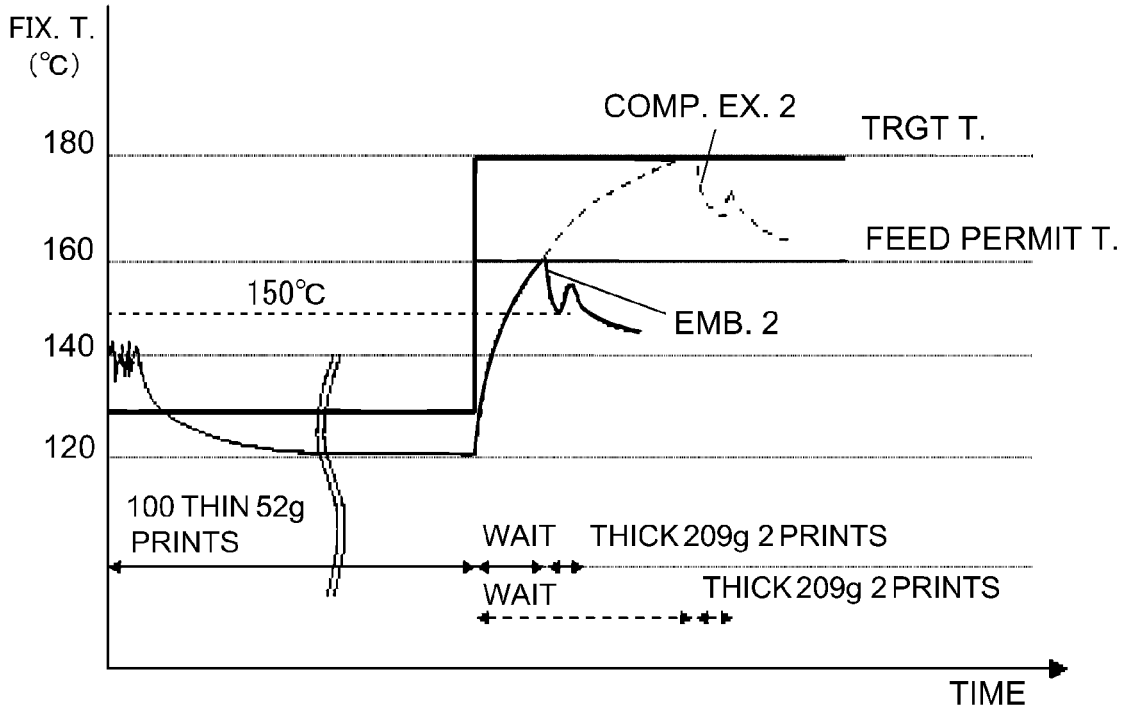
FIG. 7 is an illustration of a temperature change of a fixing roller at the time when the recording material changes from the thin sheet to the thick sheet.

FIG. 6 is a flow chart of a control according Embodiment 2. FIG. 7 is an illustration of a temperature change of a fixing roller at the time when the recording material changes from a thin sheet to a thick sheet. In Embodiment 1, in one image formation job starting in the stand-by state, an optimum temperature control stand-by time is determined on the basis of the kind of recording material when the print number is specified. In Embodiment 2, when the recording material is changed in the process of a continuous image formation, the optimum waiting time of the temperature adjustment is determined. In Embodiment 2, control of a so-called mixed job in which a job including different kinds of recording material is continuously processed, as in the case of continuous printing on a thick sheet for a cover and thin content sheets of a paperbound book is addressed.

As shown in FIG. 3, the controller 141 can control the heating of the thin sheets, which are an example of recording materials of a first kind, and then the heating of the thick sheet 3, which is an example of a second kind recording material for which the temperature of the fixing roller 51 is made higher than that for the thin sheets. The controller 141 controls the sheet feeder 10 on the basis of the temperature information. When the heating number on the thick sheets 3 is not less than a predetermined number, the controller 141 feeds the recording material into the nip at the timing when the temperature of the fixing roller 51 reaches the first temperature. When the heating number on the thick sheets 3 is less than the predetermined number, the controller 141 feeds the recording material into the nip at the timing when the temperature of the fixing roller 51 reaches the second temperature which is lower than the first temperature.

Table 2 is a media table of the feeding speed, the target temperature of the temperature adjustment and the sheet feeding permission temperature in Embodiment 2.

TABLE 2

| | | | Temp. | Sheet feed permission Temp. (Deg. C.) | |
|---|---|---|---|---|---|
| | Feeding speed | Target temp. of temp. adjustment (Deg. C.) | Diff. Deg. C. ≥30 <30 | ≥3 sheets ≥5 sheets | <3 sheets <5 sheets |
| Stand-by temp. | 0 | 140 | | Non | Non |
| Thin (52-63) | Even | 130 | | 120 | 110 |
| Plain (64-105) | Even | 150 | | 130 | 120 |
| Thick 1 (106-128) | Even | 160 | | 150 | 130 |
| Thick 2 (129-157) | Even | 170 | | 160 | 150 |
| Thick 3 (158-209) | Even | 180 | | 170 | 160 |
| Thick 4 (210-256) | Half | 160 | | 150 | 140 |

As shown in 2, the feeding speed of the recording material and the target temperature of the temperature adjustment are the same as those of Table 1 of Embodiment 1 However, the sheet feeding permission temperature is set to take into account a target temperature difference of the temperature adjustment between the jobs before and after the switching of the recording material as well as the print number of the subsequent job as in Embodiment 1.

For example, the switching is from thick sheet 1 (160 degrees C.) to a thick sheet 3 (180 degrees C.) in a mixed job, and the sheet feeding permission temperature is determined depending on whether or not the job number of thick sheets 3 is not less than or less than five sheet (A4 conversion value), since the target temperature difference is Δ20 degrees C. (less than Δ 30 degree C.). However, when the switching is from thin sheet (130 degrees C.) to thick sheet 3 (180 degrees C.), the sheet feeding permission temperature is determined depending on whether or not the job print number of thick sheets 3 is not less than or less than three (A4 conversion value the, since the target temperature difference of the temperature adjustment is Δ50 degrees C. (not less than Δ 30 degrees C.).

This is because even if the kind of recording material in the subsequent job remains the same, an inside heat accumulation state of the fixing roller 51 is different depending on the target temperature of the temperature adjustment in the prior job, and therefore, the change of the surface temperature of the fixing roller 51 after the start of the image formation in the subsequent continuous printing job is different. The accumulation heat quantity inside the fixing roller 51 increases with a decrease of the target temperature difference between the prior job and the subsequent job, and therefore, when the target temperature difference is small, the temperature drop speed after the start of the image formation of the subsequent job is slow, a relatively large number of prints can be produced by the time when the temperature decreases beyond the temperature required for the heat fixing of the toner image. When the target temperature difference is less than 30 degrees C., the temperature 150 degrees C. can be maintained until four sheet fixing operations after the start of the image formation, but when the target temperature difference is not less than 30 degrees C., the temperature 150 degrees C. is likely to be maintained until only two sheet fixing operations after the start of the image formation. Therefore, the sheet feeding permission temperature table 2 is prepared.

Referring to FIG. 3 and FIG. 6, the controller 141 executes a mixed job including 100 continuous image formations on an A4 size thin sheet and subsequent two continuous image formations on an A4 size thick sheet 3 (the recording material is switched). The controller 141 receives the recording material switching instructions to the thick sheet 3 during the preceding continuous image formations (on the thin sheet) in the mixed job (S1). When the controller 141 receives the recording material switching instructions (Si), the controller 141 determines the feeding speed of the subsequent job, the target temperature A degrees C. of the temperature adjustment and the sheet feeding permission temperature B degrees C. on the basis of recording material information before and after the switching and subsequent job print number information, referring to Table 2 (S2).

Here, the target temperature difference of the temperature adjustment between before and after the switching is 180 degrees C.−130 degrees C. =50 degrees C., which is not less than Δ30 degrees C., and the print number of the subsequent job is two. Therefore, the controller 141 referring to Table 2 determines that the feeding speed of the subsequent job is the same, that the target temperature of the temperature adjustment is 180 degrees C., and that the sheet feeding permission temperature is 160 degrees C.

Subsequent control operations (S3-S10) are similar to those of Embodiment 1, and the sheet feeding operation and the printing operation for the subsequent job are executed after necessary and minimum waiting time for the temperature adjustment. When the controller 141 receives a further recording material switching job during the sheet feeding operation and the printing operation of the subsequent job (S13), the above-described settings and waiting are carried out for the further subsequent job (S2), and the current subsequent job is carried out (S3-S10).

FIG. 7 shows a temperature change of a surface of the fixing roller 51 when the mixed job is executed in accordance with the operation flow of Embodiment 2. As shown in FIG. 7 by the solid line, according to the control of Embodiment 2, the sheet processing of a thick sheet 3 is started at a 160 degrees C. timing, which is prior to the stipulated 180 degrees C. timing, 7 sec after the switching of the target temperature. The temperature of the fixing roller 51 decreases due to the processing on the thick sheet 3, but since the print number is small, the printings on the thick sheets 3 are already completed before the surface temperature of the fixing roller 51 decreases beyond 150 degrees C. After the completion, the surface temperature of the fixing roller 51 rises, and thereafter, the heating of the fixing roller 51 is stopped, and the temperature drops.

On the contrary, in the case that the image formation on the thick sheet 3 is started after waiting for the temperature rise to the stipulated 180 degrees C. as indicated by a broken line in FIG. 7 (comparison example 2), the waiting time is 20 sec. Therefore, with the control of Embodiment 2, the image formation on the thick sheet 3 is executed after less than half the waiting time as compared with the comparison example indicated by the broken line. That is, the waiting time for the temperature adjustment at the time when the recording material is switched from the thin sheet to the thick sheet 3 is reduced from 20 sec to 7 sec.

In the control of Embodiment 2 in the mixed job including the recording materials for which the target temperatures of the temperature adjustment are different, the optimum sheet feeding permission temperature is determined on the basis of the difference of the kind of recording materials between before and after the switching and the print number information after the switching. By this, the stand-by time of the temperature adjustment is optimal, and the total productivity of the image forming apparatus 100 is enhanced.

The control of Embodiment 2 improves the media mixed productivity, that is, minimizes the down time at the time of switching of the recording material. By executing an appropriate job switching control in accordance with the recording material information and job print number information, the down time at the time of switching of recording material in the mixed job can be minimized.

<Embodiment 3>

In Embodiments 1 and 2, if the number of the image formations required to raise the target temperature of the temperature control is less than 5 (3), the target temperature of the temperature adjustment of the fixing roller is set evenly. In Embodiment 3, for less than five sheets, the target temperature of the temperature adjustment of the fixing roller is decreased with the decrease of the number of the image formations, so that the waiting time is further reduced.

The controller 141, which is an example of the feeding speed controller or the controlling means, controls the sheet feeder 10 on the basis of the temperature information. When a heating number on thick sheets 3, which is an example of a second kind recording material, is less than a predetermined number, a second temperature is lower if the heating number is smaller. If it is not less than the predetermined number, the recording material is fed into the nip at the timing of the reaching of the temperature of the fixing roller 51 up to the first temperature, which is higher than any of the second temperatures, evenly.

The first temperature is so selected that the temperature of the fixing roller at the time when the heating of the fixing roller 51 and the cooling by the recording material are balanced with each other in the continuous image forming operation to provide a constant temperature of the fixing roller is a lower limit value of the temperature necessary for the fixing of the toner image on the recording material. The second temperature is so selected that when the number of image formations exceeds such a number, the temperature may decrease beyond the lower limit value of the temperature necessary for the fixing of the toner image on the recording material.

<Embodiment 4>

In Embodiments 1 and 2, it is intended to reduce the waiting time of the image formation attributable to the change of the target temperature of the temperature adjustment for the fixing roller. In Embodiment 4, it is intended to reduce the waiting time of the image formation attributable to switching of the image forming speed.

The controller 141 sets the operation speeds of the image forming means and the image heating apparatus, which are examples of the image forming speed, to a first image forming speed and a first image heating speed, respectively, when the recording material is the first kind recording material. The controller 141 effects the control such that the operation speeds of the image forming means and the image heating apparatus are a second image forming speed and a second image heating speed, which are slower than the first image forming speed and the first image heating speed, respectively, when the recording material is a second kind recording material.

The controller 141 continuously forms images on a plurality of the first kind recording materials, and then, continuously forms images on a plurality of second kind recording materials. At this time, when the number of the second kind recording materials is not less than a predetermined number, the operation speeds of the image forming means and the image heating apparatus are decreased to the second image forming speed and the second image heating speed, respectively. However, when the number of the second kind recording materials is less than the predetermined number, the operation speeds of the image forming means and the image heating apparatus are maintained at the first image forming speed and the first image heating speed, respectively.

The image forming speed is the operation speed of the photosensitive member 3 and an intermediary transfer belt 130, and the process speed is a speed of the recording material P passing through the fixing device 9, which is the fixing speed. In this embodiment, the process speed and the fixing speed are the same. In addition, in this embodiment, the peripheral speeds of the photosensitive member 3*a* and the intermediary transfer belt 130 are the same.

The present invention is applicable to a case where the peripheral speeds of the photosensitive member 3*a* and the intermediary transfer belt 130 are slightly different. In this case, it can be deemed that peripheral speeds are the same. Therefore, the changing of the operation speed of image forming means that the peripheral speeds of the photosensitive member and the intermediary transfer belt which are slightly different from each other changes to different speeds which are slightly different from each other.

Even if the process speed and the fixing speed are slightly different from each other, the present invention is applicable. For example, depending on a section structure of the image forming apparatus, a loop of the recording material P is formed between the secondary transfer portion and the fixing device during the feeding of the recording material. More specifically, the fixing speed is set to be slower by approximately 1-3% than the process speed. The feeding speed in the description of this embodiment means either one of these speeds, and the present invention is applicable irrespective of whether or not there is a speed difference.

As shown in FIG. 3, when the heating number of thick sheets 4 which are in the example of the second kind recording material is not less than a predetermined number, the controller 141 lowers the rotational speed of the fixing roller 51 and then feeds the recording material into the nip. When the heating number of the thick sheets 4 is less than the predetermined number, the controller feeds the recording material into the nip without changing the rotational speed of the fixing roller 51.

Table 3 is a media table of the feeding speed, the target temperature of the temperature adjustment and the sheet feeding permission temperature in Embodiment 4

TABLE 3

| | | Target | Temp. | Sheet feed permission Temp. (Deg. C) | | Sheet feed speed switching | |
|---|---|---|---|---|---|---|---|
| | Feed speed | temp. of temp. adjustment (Deg. C) | Diff. Deg. C ≥30 <30 | ≥3 sheets ≥5 sheets | <3 sheets <5 sheets | ≥3 sheets ≥5 sheets | <3 sheets <5 sheets |
| Stand-by T . . . | 0 | 140 | | Non | Non | Non | Non |
| Thin (52-63) | Even | 130 | | 120 | 110 | Non | Non |
| Plain (64-105) | Even | 150 | | 130 | 120 | Non | Non |
| Thick 1 (106-128) | Even | 160 | | 150 | 130 | Non | Non |
| Thick 2 (129-157) | Even | 170 | | 160 | 150 | Non | Non |
| Thick 3 (158-209) | Even | 180 | | 170 | 160 | Non | Non |
| Thick 4 (210-256) | Half | 160 | | 150 | 140 | Yes | Non |

As shown in Table 3, the settings of the feeding speed, the target temperature of the temperature adjustment and the sheet feeding permission temperature are fundamentally similar to those of Table 2 of Embodiment 2. However, in Embodiment 3, it is determined on the basis of the print number of a subsequent job of the thick sheet 4 whether to execute the switching over the feeding speed for the subsequent job.

As shown in FIG. 3, a mixed job will be taken for example, in which the recording material is continuously switched from an A4 size thick sheet 1 (160 degrees C., 320 mm/sec) to a thick sheet 4 (160 degrees C., 160 mm/sec). In this case, the target temperature difference of the temperature adjustment is Δ0 degrees C., and therefore, when the print number on the thick sheets 4 is not less than five (A4 size conversion), the controller 141 waits for completion of all the image formations of the prior job and then switches the feeding speed of the intermediary transfer belt (130 in FIG. 1) and the like from the same speed to the half-speed. When the print number is large, the temperature drop of the fixing roller 51 in the continuous image formation on the thick sheets 4 which absorbs large quantity of heat, and therefore, in order to increase the supplied heat quantity per one sheet, it is necessary to lower the feeding speed.

However, when the print number on the thick sheets 4 is less than five, the controller 141 executes the subsequent job on the thick sheets 4 without changing the feeding speed. This is because even when the thick sheet 4 which absorbs a large quantity of heat is processed, if the number is small, the subsequent job will be completed before the surface temperature of the fixing roller 51 lowers too much, without changing the feeding speed. For the same reasons as with Embodiments 1 and 2, the waiting time can be reduced for the switching of the feeding speed as well as for the temperature adjustment.

Referring to FIG. 3 and FIG. 6, the controller 141 discriminates whether to execute the switching of the feeding speed, at the time when the kind of recording material is switched in the mixed job (S2). When the controller 141 discriminates the switching to be executed (Y of S3), the switching of the feeding speed is executed (S12).

The switching operation of the feeding speed has to be carried out at every portions (image forming stations Pa, Pb, Pc, Pd, the fixing device 9, the feeding portion 7 and the sheet feeder 10) in the image forming apparatus 100, and in addition, it can be carried out only after the completion of the prior job. For this reason, it requires a long time with the result of a long down time of the image forming apparatus 100.

However, in Embodiment 3, the controller 141 does not switch the feeding speed (N of S3) if not necessary, and proceeds to the temperature control (S4) to start the subsequent job without changing the feeding speed, and therefore, the time required for switching the feeding speed can be saved.

The effect of the control of Embodiment 3 has been checked. A mixed job has been executed in an image forming apparatus 100, in which the operation is switched from the continuous 100 image formations on A4 size thick sheet 1 to two continuous image formations on the A4 size thick sheets 4. Without using Embodiment 3, the switching of the feeding speed at the time when the recording material is switched requires approx. 15 sec.

By the image formation without changing the feeding speed when the number of the A4 size conversion sheets is less than five, the mixed job has been carried out without problem. No significant difference is recognized between this case and in the case in which the feeding speed is switched unconditionally, in the image quality (fixing property, glossiness property and quality) of the small number of sheets. In the mixed job, if the print number of the subsequent job it small, an optimum feeding permission temperature (a temperature at which the feeding of the recording material from the recording material cassette starts) or the feeding speed is selected on the basis of recording material information before and after the switching of the recording material, by which the media switching time can be minimized. According to the control of Embodiment 4, the productivity of the image forming apparatus 100 can be improved.

In the foregoing, Embodiments 1-4 has been described in detail, but the present invention is not limited to these embodiments, and the following examples are applicable.

For example, the heating member and the pressing member may be belt members or roller members. At least one of the heating member and the pressing member may be a seamless belt. A fixing device comprises a detachably mountable nip constituted by a heating member in the form of a seamless belt and a contacting and spacing mechanism.

The heating type of the fixing member is not limited to the halogen lamp heater but may use another type such as induction heating or the like.

The image formation system of the image forming apparatus may be a type in which a color image this form of using a single photosensitive member, or a type in which images a transfer from photosensitive members while attracting and carrying the recording material on a recording material feeding belt.

In the foregoing embodiments, a printer has been taken as examples, the present invention is applicable to various uses including a copying machine, a facsimile machine and a complex machine having a plurality of such functions.

INDUSTRIAL APPLICABILITY

According to the present invention, an image forming apparatus which can properly carry out of the image forming operation with minimized waiting time.

The invention claimed is:

1. An image forming apparatus comprising:

an image forming portion configured to form a toner image on a sheet;

a fixing portion configured to fix the toner image formed on the sheet by said image forming portion; and a controlling portion configured to control the operation speed of each of said image forming portion and said fixing portion when an image formation process is continuously performed for a plurality of sheets, wherein when the number of the image formation processes is not less than a predetermined number, said controlling portion sets the operation speeds at speeds based on the type of the sheet, and wherein when the number of the image formation processes is less than the predetermined number, said controlling portion sets the operation speeds at speeds which are higher than the operation speeds based on the type of the sheet.

2. An apparatus according to claim 1, wherein said image forming portion includes a rotatable photosensitive member on which the toner image is formed, and said fixing portion includes a rotatable heating member configured to heat the toner image on the sheet in contact therewith, and wherein said controlling portion controls the peripheral speed of said photosensitive member as the operation speed of said image forming portion, and controls the peripheral speed of said heating member as the operation speed of said fixing portion.

3. An apparatus according to claim 1, wherein when the image formation process is performed for the sheet having a basis weight which is less than a predetermined basis weight, said controlling portion sets the operation speeds at first speeds, and wherein when the image formation process is performed for the sheet having a basis weight which is not less than the predetermined basis weight, said controlling portion sets the operation speeds at second speeds which are slower than the first speeds.

4. An image forming apparatus comprising:

an image forming portion configured to form a toner image on a sheet;

a fixing portion configured to fix the toner image formed on the sheet by said image forming portion;

a first controlling portion configured to control the operation speed of each of said image forming portion and said fixing portion when an image formation process is continuously performed for a plurality of sheets; and a second controlling portion configured to control the start timing of the image formation process, wherein in a case that the image formation process is continuously performed for a plurality of sheets each having a first basis weight in a state that the operation speeds are set to first speeds, and then successively, the image formation process is continuously performed for a plurality of sheets each having a second basis weight which is larger than the first basis weight, said second controlling portion starts the image formation process after decreasing the operation speeds to second speeds which are slower than the first speeds, if the number of the image formation processes is not less than a predetermined number, and said second controlling portion starts the image formation process while maintaining the operation speeds at the first speeds, if the number of image formation processes is less than the predetermined number.

5. An apparatus according to claim 4, wherein said image forming portion includes a rotatable photosensitive member on which the toner image is formed, and said fixing portion includes a rotatable heating member configured to heat the toner image on the sheet in contact therewith, and wherein said first controlling portion controls the peripheral speed of said photosensitive member as the operation speed of said image forming portion, and controls the peripheral speed of said heating member as the operation speed of said fixing portion.

* * * * *